United States Patent [19]

Hastings

[11] 3,971,337

[45] July 27, 1976

[54] APPARATUS FOR ELECTROSTATICALLY SPRAYING HIGHLY ELECTRICALLY CONDUCTIVE WATER-BASED COATING MATERIAL

[75] Inventor: Donald R. Hastings, Elyria, Ohio

[73] Assignee: Nordson Corporation, Amherst, Ohio

[22] Filed: Jan. 29, 1975

[21] Appl. No.: 545,153

[52] U.S. Cl. ..... 118/629; 138/137; 138/141; 138/146; 174/9 F

[51] Int. Cl.[2] ..... B05B 5/02

[58] Field of Search ..... 118/629; 174/9 F; 138/137, 141–146, 177

[56] References Cited

UNITED STATES PATENTS

| | | | |
|---|---|---|---|
| 2,784,350 | 3/1957 | Sedlacsik | 118/629 |
| 3,412,198 | 11/1968 | Wallis | 174/9 F |
| 3,734,139 | 5/1973 | Zafiroglu | 138/146 |
| 3,878,312 | 4/1975 | Bergh et al. | 174/9 F |

*Primary Examiner*—Louis K. Rimrodt
*Assistant Examiner*—Douglas Salser
*Attorney, Agent, or Firm*—Wood, Herron & Evans

[57] ABSTRACT

An electrostatic spray apparatus and method for spraying highly electrically conductive water-based coating material in which safety hazards are minimized. Included is a spray gun from which electrostatically charged water-based coating material is emitted toward an electrically grounded object to be coated; an enclosure of insulative material having upper and lower compartments electrically isolated from each other; a metallic coating supply container or tank located in the upper compartment for supplying coating material to the gun; an insulative hose interconnecting the tank and gun having a section thereof which passes through the lower compartment; a charging electrode located in the lower compartment in communication with the bore of the hose; a high voltage source connected to the charging electrode for charging the coating as it passes through the section of hose in the lower compartment; an opening in the upper compartment normally closed by a cover to facilitate access to the tank for replenishing the coating material; and a high voltage switch located in the lower compartment which is automatically actuated concommitantly with removal of the enclosure cover to electrically ground the charging electrode, and hence the system, thereby eliminating shock hazards when the tank is accessed for replenishment purposes and the like. Other features are also disclosed.

9 Claims, 4 Drawing Figures

APPARATUS FOR ELECTROSTATICALLY SPRAYING HIGHLY ELECTRICALLY CONDUCTIVE WATER-BASED COATING MATERIAL

This invention relates to electrostatic spray coating and more particularly to an apparatus and method for minimizing safety hazards when electrostatically spraying highly electrically conductive water-based coating material.

In the recent past there has been a considerable increase in the emphasis placed on providing employees, particularly in the industrial field, with working conditions which are free from recognized safety and health hazards. This trend has, in part, been the result of the Occupational Safety and Health Act which requires employers to provide their employees with safe places of employment. In the field of electrostatic paint spraying, in an effort to comply with various safety and health regulations issued pursuant to the Occupational Safety and Health Act, there has been a marked trend among employers to switch from solvent-based coatings to water-based coatings. Coating materials of the solvent-based variety, such as varnishes, lacquers and the like create an atmosphere which is both explosive and toxic. The explosive nature of the environment presents a safety hazard should a spark inadvertently be generated, such as by accidentally electrically grounding the nozzle of the spray gun, which can then ignite the solvent in the atmosphere, causing an explosion. The toxic nature of the workplace atmosphere creates a health hazard should the employee inhale the solvent vapors which are present.

Because both of the foregoing hazards are eliminated by switching to water-based coatings, the increased emphasis on providing employees with safe and healthful workplaces has resulted in a shift by industry to electrostatic spray coating products of the water-based type. Unfortunately, the switch from electrostatically spraying solvent-based coatings to those of the water-based type has sharply increased the risk of electrical shock, which risk was relatively minor with solvent-based coatings. Specifically, the increased risk of electrical shock accompanying electrostatic spraying of water-based paints is occasioned by the fact that water-based paints are extremely electrically conductive, with resistivities often falling in the range of 100–10,000 ohm-centimeters. This is in contrast to resistivities of 200,000–1,000,000 ohm-centimeters for moderately electrically conductive coatings such as metallic paint, and resistivities exceeding 1,000,000 ohm-centimeters for solvent-based lacquers, varnishes, enamels, and the like.

By way of background, with coating materials which are either not electrically conductive or only moderately electrically conductive, as is the case with metallic and solvent-based paints, the charging electrode, which is maintained at a high electrostatic potential, is usually placed near the nozzle of the spray device thereby electrostatically charging coating material as it is emitted. Due to the relatively high resistivity of the coating material, when the electrode is so placed, the column of coating material in the hose, which connects the spray device to the coating supply tank, has sufficient electrical resistance to prevent any significant electrostatic charging of the material in the tank or the tank itself. However, when the coating material is highly electrically conductive, as is the case with water-based paints, the resistance of the coating column in the hose is very low, with the result that a high voltage charging electrode located in the vicinity of the spray device nozzle, electrostatically charges not only the emitted particles, but the coating material in the hose and supply tank, as well as the supply tank itself. Under such circumstances, operating personnel inadvertently coming into contact with an exposed supply tank risk serious electrical shock.

To avoid the aforementioned electrical shock problem associated with a system in which highly conductive water-based coating material in the hose and tank becomes charged as an incident to spraying, it has been proposed in the past to enclose the supply tank in an electrically insulative housing. However, even when this is done electrical shock hazards still exist, particularly when the insulative enclosure is opened to expose the tank and gain access thereto for replenishing the coating supply. Such hazards exist, notwithstanding that the electrostatic charging source may have been de-energized prior to accessing the coating tank, due to the fact that the electrostatic charge on the coating material in the tank and hose does not immediately dissipate, or discharge, following de-energization of the electrostatic charging source, but rather requires a finite time, dependent on existing current leakage paths, to discharge to a nonhazardous level. Thus, a residual charge of a hazardous level, albeit gradually decreasing, remains on the tank for a finite time, often as long as 40 seconds, after the electrostatic charging source is de-energized. Hence, operating personnel contacting the coating container after de-energization of the charging source, but prior to reduction of the residual electrostatic charge to a safe level, are exposed to shock hazards.

Accordingly, it has been an objective of this invention to provide an apparatus and method for electrostatically spraying highly conductive water-based coating material which minimizes shock hazards heretofore existing when a normally enclosed tank of conductive coating material is accessed following de-energization of the charging source, but prior to discharge of the residual electrostatic charge on the coating material through the normal current leakage process. This objective has been accomplished in accordance with certain principles of this invention by providing, in combination with an insulative enclosure surrounding a tank containing electrostatically charged water-based coating material, means for automatically electrically grounding the system as a concommitant to removal of the enclosure cover to access the tank. As a consequence, residual charge in the system is automatically and immediately dissipated to ground as an incident to accessing the paint tank, eliminating shock hazards which heretofore existed when a tank was accessed shortly after de-energizing the charging source, but prior to dissipation of the stored residual charge.

In a preferred form of the invention the automatic electrostatic grounding arrangement includes a high voltage grounding switch located in a compartment of the insulative enclosure separate and apart from the compartment in which the paint tank is housed. Upon removal of the cover of the tank compartment, the high voltage switch, which is connected between the tank and ground, automatically discharges the system to ground potential. Placement of the high voltage switch in a separate compartment, vis-a-vis in the same compartment as the tank, provides a number of advantages. For example, by reason of the high voltage switch being absent from the tank compartment, the switch is protected against possible damage due to paint spillage, jarring or the like, as an incident to tank replenishment and/or removal. In addition, the high voltage switch compartment, by reason of being separate from the tank compartment, can be sealed against unauthorized tampering or the like without inconveniencing personnel needing access to the tank compartment for replenishment purposes, etc. Finally, the size of the tank compartment can be made smaller since the requisite electrical standoff between the tank and compartment walls can be provided by measuring directly from the tank to the compartment walls, rather than from the compartment walls to the high voltage electrical switch which, if located in the tank compartment, would be mounted on the tank, thereby increasing the actual distance required between tank and compartment walls to provide a predetermined electrical standoff.

In accordance with another aspect of the invention, the hose which supplies paint from the tank to the spray device passes through the high voltage switch compartment whereat an electrode communicating with the bore of the hose carrying the conductive water-based paint is alternatively selectively connected to either (a) the high voltage source for charging the paint as it flows through the hose or (b) ground potential via the high voltage switch for discharging the system. By virtue of this arrangement, the paint hose serves multiple purposes. Specifically, it transports paint from the tank to the gun, as well as establishes a conductive path for both charging the paint and grounding the system. Thus, separate electrical conductors interconnecting the tank to the charging source and high voltage grounding switch are unnecessary. Not only does this reduce cost, but it makes tank removal for maintenance or like purposes easier since once the tank compartment cover is removed and the tank accessible, the only fitting or connecting to the tank requiring disconnection is the fitting interconnecting the tank and paint hose. A second hose, which supplies air to the tank for pressurizing the paint, is typically connected to the tank cover. However, the tank can be removed without disconnecting this hose by merely removing the cover from the tank before removing the tank itself.

A further advantage of this particular aspect of the invention is that separate openings between the tank and high voltage switch compartments need not be provided for electrical conductors which might otherwise be needed were separate conductors designed to charge the paint and discharge the system provided. The only openings in the wall separating the compartments which are needed are those necessary to accommodate the paint and air hoses. Accordingly, only two seals need be provided in the wall between the compartments, reducing initial equipment manufacturing cost as well as operating problems occasioned by paint leakage from the tank compartment into the high voltage switching compartment.

In the preferred form of the invention, the high voltage switch includes an electrically grounded rod pivotally mounted within the switch compartment. The rod, upon removal of the tank compartment cover, is moved into electrically conductive contact with the paint hose electrode by a linkage which interconnects the cover and rod, thereby grounding the system through the paint column in the hose and dissipating the residual charge on the coating material in the tank hose and gun.

Another aspect of this invention contemplates electrically grounding the system means of the high voltage grounding switch under remote control from the gun trigger, whenever the user of the gun releases the trigger for an abnormal period of time exceeding the normal, momentary-type release typically encountered in the course of spraying an article. A typical example of such an abnormal, long-duration trigger release is when the user must interrupt spraying for a protracted period to replenish the tank. Since a user is more likely to inadvertently touch the gun nozzle and receive a shock when he has finished spraying and, for example, contemplates replenishing the tank, than he is when engaged in spraying an article, by grounding the system automatically each time spraying is concluded, shock hazards are minimized. Of course, momentary trigger releases, since they do not result in discharging the system, do not interfere with normal spraying, as might otherwise occur were the system discharged every trigger release, due to the lag time necessary for the charge to build up to the desired operating level following turn-off.

In accordance with a further aspect of the invention, also designed to minimize shock hazards, an electrical switch in the energization circuit of the high voltage power supply is provided which, upon removal of the insulative cover from the enclosure surrounding the tank, disables the high voltage charging supply. Thus, when the cover of the insulative enclosure is removed, thereby exposing the tank, the supply of electrostatic charging potential to the coating material is automatically terminated.

In accordance with a still further aspect of the invention, also designed to minimize safety hazards, a second electrical switch is connected in the energization circuit of the high voltage power supply. The second switch is designed to be placed in an open circuit condition, thereby automatically de-energizing the high voltage supply, when the spray gun trigger is released to stop the flow of coating material to the gun. Should the operator, after concluding spraying, accidentally cause the nozzle of the gun, which is typically charged due to the conductive nature of the coating material, to come into contact with a grounded object, such as in the course of placing the gun on a support, the likelihood of electrical shock due to inadvertent grounding is minimized.

In accordance with another aspect of the invention, also designed to minimize electrical shock hazards and extend the life of the hose used to interconnect the gun and tank, the hose is constructed in a very unique manner never before used in water-based coating spray systems. Specifically, the hose is provided with a dielectric wall which has a zone in contact with the water-based coating which is substantially chemically inert and impermeable to the coating, as well as constructed to withstand dielectric breakdown when subjected to the electrostatic charging potential by the charged paint flowing through the hose. In addition, the hose has an exterior surface free of electrically conductive material. The impermeability and inertness of the dielectric wall to the water-based paint prevents it from physically deteriorating and becoming water-logged which, if permitted to occur, would eventually lead to arcing through the wall and ultimately failure of the hose. The absence of an outer cladding of conductive material minimizes the capacitance of the hose, and hence the electrical energy stored therein in capacitive form, particularly when the hose is physically spaced from a grounded object, such as a factory floor. Reduction in stored energy reduces shock hazards should an operator inadvertently contact the gun nozzle before the system has been discharged, such as while spraying. Even when the conductively unclad hose of this invention is in contact with a grounded surface, such as a factory floor, its capacitance, and hence energy storing capability, is still significantly less, e.g., 50%, than conductively clad hoses. Thus, shock hazards are significantly reduced with the conductively unclad hose of this invention even when the hose rests on a grounded factory floor or like grounded surface.

These and other advantages and objectives of the invention will become more readily apparent from a detailed description of the preferred embodiment taken in conjunction with the drawings in which:

FIG. 3 is an elevational view of a modified form of grounding mechanism; and

Figure 1:
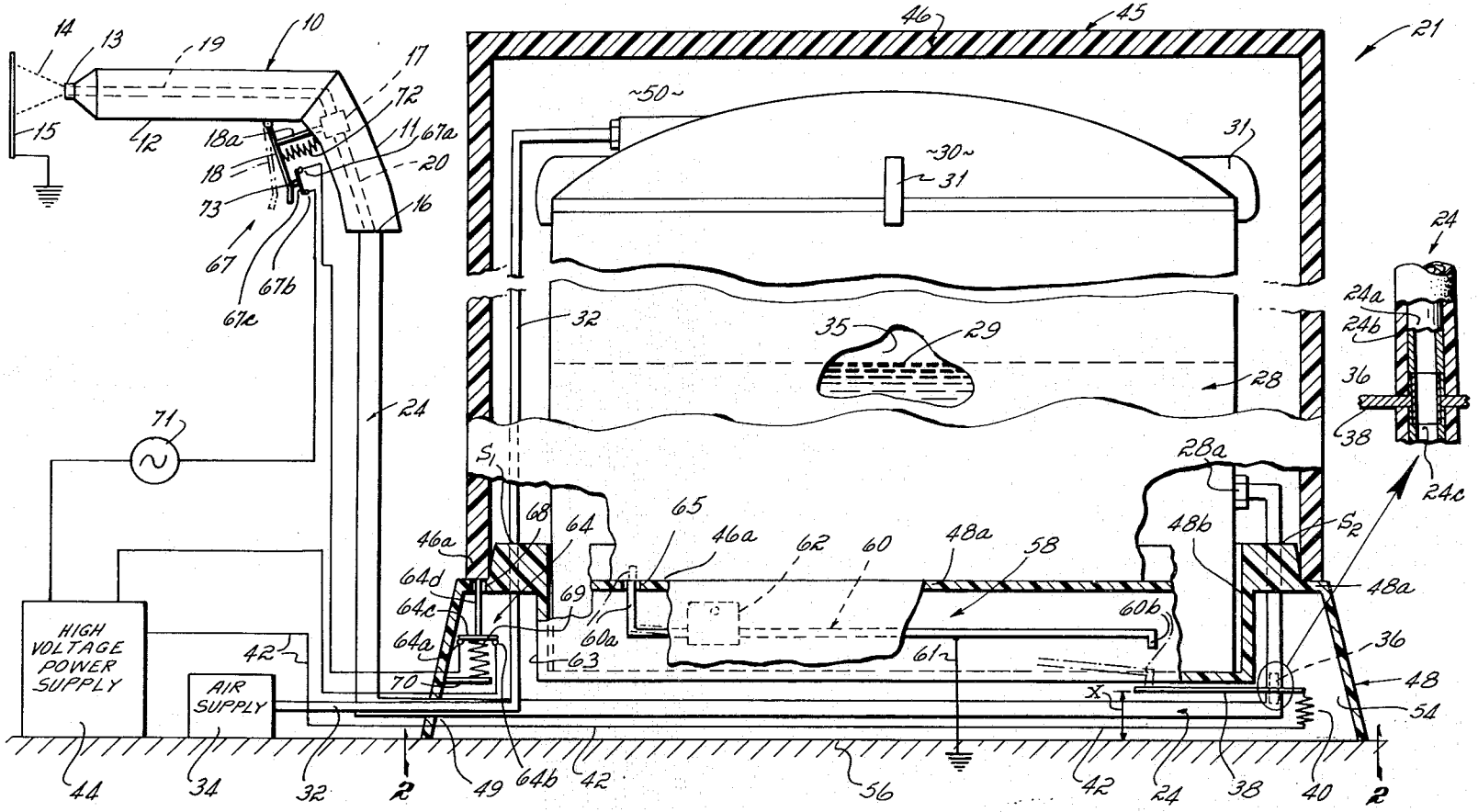
FIG. 1 is an elevational view, partly in cross-section, of the spray device, coating container and interconnecting hose 1 showing the electrical interlock and automatic system grounding features of this invention.
Figure 2:
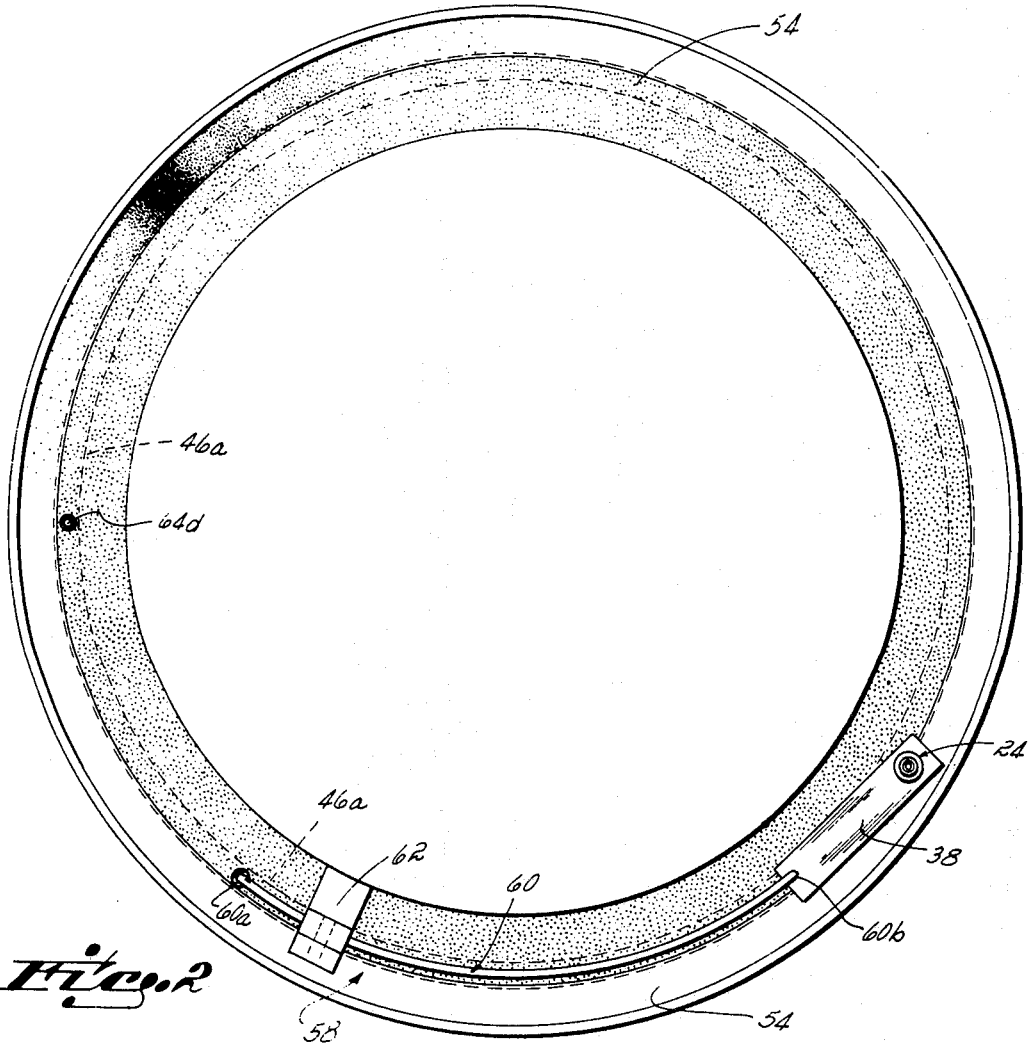
FIG. 2 is a bottom view taken along line 2—2 of FIG. 1.
Figure 5:
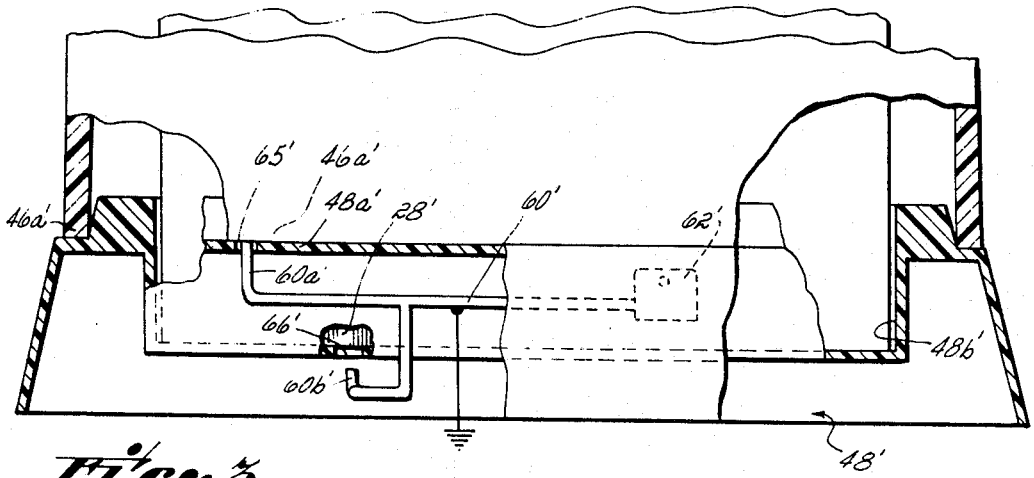

Electrostatic spray coating systems of the general type to which this invention relates are designed to spray highly electrically conductive water-based coating materials, i.e., having resistivities in the range of 100–1,000,000 ohm-centimeters. By way of illustration only, one such water-based coating material frequently used is water-soluble bake enamel, manufactured by Muller Industries, having a resistivity of 318 ohm-centimeters. Typically these systems include, as a principle component thereof, an electrostatic spray device such as an electrostatic spray gun 10. The gun 10 has an electrically grounded handle 11 of electrically conductive material designed to be manually grasped in use by the operator and an electrically insulative barrel 12 which at its forward end terminates in a nozzle 13. A spray 14 of finely divided, or atomized, particles of highly conductive coating material flows from the gun nozzle toward an object 15 being coated when a manually-operated actuator on the handle, such as a trigger 18, is actuated by the operator. A source of coating material 21 is connected to a coating inlet 16 of the gun 10 via a flexible conduit, hose or supply line 24. The coating inlet 16 communicates with the nozzle 13 via fluid passages 19 and 20 in the barrel 13 and handle 11, respectively. Actuation of the gun trigger 18 opens a normally closed flow valve 17 in the gun 10 via an interconnecting plunger **18*a* to permit the flow of conductive coating material to the nozzle 13 whereat it is atomized and emitted as the spray 14**.

Electrostatic spray systems also include an electrical power pack, or booster supply, for transforming commercially available low voltage AC power, e.g., 60 Hertz – 115 volts, to high DC voltage, e.g., 50KV – 100KV, and an electrode connected to the high voltage power supply and in contact with the conductive coating material for electrostatically charging the coating material such that as coating particles are emitted from the gun nozzle their attraction to the article 15 being coated, which is typically maintained at a potential different than that of the charging potential, for example, at zero or ground potential, will be enhanced.

Depending upon whether or not the gun is of the "air" type, wherein atomization of the coating material is effected by impact of an air stream with the liquid coating material, a source of air may or may not be connected to the gun via an air line for impinging air on the coating stream in the region of the nozzle. If the spray gun is of the "airless" type, wherein atomization of the coating particles in the region of the nozzle is effected hydraulically, the air line may be omitted. The electrostatic spray gun 10 which is illustrated is of the airless type. However, it should be understood that the invention is equally applicable to other types of electrostatic, manual and automatic, spray guns and systems.

The fluid conduit or hose 24 interconnecting the coating inlet 16 of the gun 10 and the source of coating material 21 preferably includes an inner dielectric layer **24*a* and an outer dielectric layer 24*b***.

The inner layer or zone **24*a* is preferably chemically inert with respect to the water-based coating being transported within the central bore 24*c* defined thereby such that the surface of layer 24*a* will not be significantly corroded, dissolved, eroded, or otherwise physically or chemically deteriorated by chemical interaction with the coating being conveyed through the bore. The inner layer 24*a* is also preferably essentially impermeable with respect to the coating conveyed through bore 24*c*, effectively establishing a fluid-tight barrier between the coating-transporting bore 24*c* and the remaining layer or zone 24*b* of the conduit 24. Tetrafluroethylene has been found to be both chemically inert and impermeable to water-based paints and therefore a good material from which to construct layer 24*a***. When tetrafluroethylene is used, a wall thickness of 40 mils is preferable.

The establishment of a barrier between the bore **24*c* and zone 24*b* which, with respect to the coating being transported, is substantially fluid-tight limits possible permeation of the dielectric zone 24*b* by the coating should the latter zone be permeable, which is often the case where the zone 24*b* is fabricated of flexible dielectric material since many flexible dielectric materials are permeable to water-based coatings. Were significant permeation of zone 24*a* permitted to occur, an electrically conductive path through the zone 24*b* could be established, assuming the latter is permeable, leading to undesirably high electrical current leakage in a radial direction through the wall of conduit 24**.

The layer or zone **24*b* functions, in combination with the inner zone 24*a*, to establish a dielectric breakdown resistant barrier in the radial direction which withstands dielectric breakdown when the interface between the inner zone 24*a* and the coating in bore 24*c* is subjected to a high voltage as necessarily occurs when the electrostatic charging voltage is applied to the interface via the column of highly conductive water-based coating in the bore 24*c* which is in electrical contact with the electrostatic charging source. In a preferred form of the invention, the dielectric breakdown resistant zone 24*b* is fabricated of extruded hollow low density polyethylene tubing having a thickness of approximately 60 mils. Such a construction is relatively flexible, in addition to having the desired electrical properties of low radial current leakage and high dielectric breakdown resistance. Specifically, polyethylene has a resistivity of $10^{15} - 10^{16}$ ohm-centimeters and a dielectric breakdown resistance of approximately 700 volts per mil and, like zone 24***a*, resists substantial radial electrical current leakage flow and dielectric breakdown when subjected to voltages thereacross on the order of the charging potential. Other dielectric materials could be utilized for layer 24*b* depending upon the degree to which it is desired that the zone material be chemically inert and impermeable to the water-based coating. For example, polypropylene and vinyl plastics may be used.

It has been found desirable to fabricate the zones 24*a* and 24*b* of material which provides a combined, or average, dielectric strength of approximately 800 volts per mil, although average, or combined, dielectric strengths ranging between 250 volts per mil and 1,000 volts per mil are satisfactory for specific applications. If composite dielectric strengths of lesser values are used, the thickness of the conduit wall measured in the radial direction may become undesirably large, increasing the bulk and stiffness of the coating conduit.

If desired, the hose layer 24*b* may be provided with a tough outer layer or skin of polyurethane (not shown) for abrasion-resistance purposes. A polyurethane skin thickness of 25 mils has been found to afford satisfactory resistance to abrasion.

The outer surface of the hose 24, whether it be layer 24*b* or an abrasion-resistant polyurethane skin (not shown), is free of electrically conductive material, i.e., does not contain a layer or cladding of conductive material. It has been discovered, when conductive cladding is omitted in construction of a hose used to spray highly conductive water-based coatings, that the capacitance of the hose is significantly reduced, particularly when the hose is spaced from a ground surface such as a factory floor, in comparison to the capacitance of a conductively clad hose. By reducing the capacitance of the hose, its ability to store electrical energy in capacitive form is reduced, in turn reducing shock hazards should an operator inadvertently contact the nozzle of the spray device when the system is in charged state, such as when the operator is spraying with the power supply energized. Even when the conductively unclad hose of this invention is in contact with a grounded surface, such as a factory floor, its capacitance, and hence energy-storing capability, is still significantly less, e.g., 50%, than a conductively clad hose. Thus, shock hazards are reduced with the conductively unclad hose of this invention even when the hose rests on a grounded factory floor or like grounded surface.

The coating material source 21 includes an inner metallic container, preferably aluminum, of conventional design capable of holding anywhere from one gallon to 50 gallons of highly electrically conductive coating material 29. The coating material container or tank 28 is provided with a removable aluminum cover 30 which in use is held in sealed engagement with the coating-containing tank via circumferentially spaced clamps 31. An air conduit 32, preferably of electrically insulative material, is connected between the tank cover 30 and a pressurized air supply 34 to subject the interior 35 of the tank 28 above the level of the coating 29 to pressurized air for maintaining the coating material under pressure. With the coating material 29 in the tank 28 pressurized, the coating is pressure fed to the gun 10 via the hose 24 and a suitable fitting 28*a* in the container wall. If desired, an air-operated agitating mechanism (not shown) having an impeller immersed in the coating material 29 can be provided for the purpose of insuring that the coating material in container 28 is maintained in a homogenous state.

As noted, the coating material 29, with respect to which this invention possesses a particularly high degree of utility, typically has a resistivity in the range of 100–1,000,000 ohm-centimeters. While a specific resistivity range has been used to define high conductivity water-based coating, it is understood that such a resistivity value is arbitrary and relative, and employed only for the purpose of illustration. Accordingly, a coating material having a resistivity above 1,000,000 ohm-centimeters could conceivably be considered as highly conductive notwithstanding that it falls near, although without, the specific numerical value given.

Connected in the hose 24 is an electrically conductive fitting 36 which communicates with the hose bore 24*c* and hence with the coating material pressure fed from the container 28 to the spray gun 10. Electrically connected to the fitting 36 is an electrically conductive plate 38. The plate 38 is connected via a current limiting resistor 40 to an electrically insulated high voltage line 42 output from a source of high voltage DC electrostatic charging potential 44. Conductive coating material pressure fed from the container 38 to the gun 10 via the hose 24 is electrostatically charged to the desired high voltage potential, e.g., 50KV – 100KV, as it passes through the electrically conductive fitting 36. Since the coating material is highly electrically conductive, the column of coating material within the hose bore 24*c* and gun passages 19 and 20 is also at the electrostatic charging potential output from the voltage supply 44 on line 42. Thus, the atomized coating material 14 emitted from the gun nozzle 13 is electrostatically charged at the potential of line 42, and the charged coating particles will be attracted to the grounded article 15 being coated. In addition, the coating material 29 within the metallic container 28, as well as the metallic container itself, are at the potential of high voltage line 42 due to the conductive nature of the coating material in the container and in the section of hose between the electrostatic charging fitting 36 and the tank outlet fitting 28*a*.

An electrically insulative enclosure 45, including a removable electrically insulative cover 46 and an electrically insulative base 48, is provided to completely enclose, and hence electrically insulate from the surrounding environment, the container 28. Specifically, when the cover 46 is located with its lower rim 46*a* seated on a cooperating peripheral ledge or lip 48*a* of the base 48, a chamber 50 is provided within which the metallic container 28 is located in electrical isolation from the environment. Preferably, the insulative base 48 is configured to provide a well 48*b* within which the lower portion of the container 28 nests. Obviously, when the enclosure cover 46 is removed from seating engagement with the base 48 to expose the container 28, access to the container is provided such that the cover 30 can be removed and the container replenished with coating material. The enclosure 45, and particularly cover 46, are sized such that the point whereat the tank 28 comes closest to the enclosure is spaced from the enclosure by a distance sufficient to provide an "electrical standoff" between the tank and the enclosure.

The enclosure 45, particularly the region enclosed by the base 48 located below the well 48*b*, defines a second chamber 54. Located within the chamber 54 is the electrically conductive plate 38 and fitting 36. Preferably fitting 36 and plate 38 are spaced from the floor or the like support 56 on which the base 48 sits by a distance X sufficient to provide an "electrical standoff" between the floor 56 which is typically at ground potential and the conductive elements 36 and 38. This prevents arcing between ground and the conductive elements 36 and 38 when the latter are electrostatically charged from the high voltage power supply 44 via electrically insulative cable 42 which passes through a suitably located aperture 49 in the base.

Also located within the chamber 54 is a system grounding assembly 58 which, in a manner to be described, functions as a high voltage switch to electrically ground the system when the enclosure cover 46 is removed from the base 48, i.e., as a concomitant to cover removal. The system ground assembly or high voltage switch 58, in a preferred form, includes an electrical conductor 60, preferably in the form of an elongated conductive rod, which is connected to ground potential via an electrical line 61. The electrically conductive rod 60 is mounted for pivotal movement by a bracket 62 secured to the inner wall 63 of the base 48. One end 60*a* of the pivotally mounted conductive rod 60 extends vertically upwardly through an aperture or hole 65 in the lip 48*a* of the base 48 at a point which underlies the cover rim 46*a*, while the other end 60*b* of the conductive rod 60 extends vertically downwardly. The rod 60 is biased by suitable spring means (not shown) such that the rod tends to pivot in a clockwise direction about bracket 62 as viewed in FIG. 1.

When cover 46 is in its closed position with respect to the base 48, such that cover rim 46*a* seats on base lip 48*a*, the rod end 60*a* is urged downwardly by the cover rim to the solid line position shown in FIG. 1. With rod end 60*a* in the solid line position due to depression thereof via the cover rim 46*a* seating on base lip 48*a*, the rod 60 is located at its counterclockwise limit of travel (shown in solid lines) in which the rod end 60*b* is spaced from the conductive plate 38. Thus, with the cover 46 in place on the base 48 and the conductive rod 60 in its solid line position shown in FIG. 1, the electrically grounded conductive rod end 60*b* is displaced from the electrically conductive plate 38, with the result that the system is not grounded.

When the cover 46 is removed and its lower rim 46*a* no longer seats on base lip 48*a*, the rod end 60*a* is free to move upwardly through aperture 65 to the dotted line position shown in FIG. 1 due to the spring bias action, with the result that grounded rod end 60*b* makes electrical contact with the electrically conductive plate 38. Since the electrically conductive plate 38 also makes electrical contact with the conductive coating material in the tube bore 24*c* via the conductive fitting 36, and in turn with the coating material 29 in the container 28, the system is electrically grounded when cover 46 is removed.

While in the preferred embodiment the system is grounded when the cover 46 is removed by electrically grounding the conductive plate 38, it will be apparent to those skilled in the art that electrical grounding of the system could be accomplished in other suitable manners. For example, the grounded conductive rod 60 could make contact directly with the metallic container 28 by relocating the pivot 62 and rod element 60*b* as shown in FIG. 3, such that element 60*b* moves through an aperture 66' in the well 48*b* underlying container 28' in response to removal of the cover 46' which permits rod end 60*a'* to rise through aperture 65' in lip 48*a'* underlying cover rim 46*a'*. A still further variant comprehends providing a microswitch in the base 48 which, upon removal of the cover 46, is actuated to energize a relay, solid state switch or the like. The relay, in turn, when energized, would complete an electrical circuit between the metallic container 28 or conductive plate 38 to a source of electrical ground potential.

By virtue of providing automatic system grounding, safety hazards, such as electrical shock, are minimized when the cover 46 is removed by operating personnel to gain access to the container 28 for refilling it with coating material or the like. As previously noted, since the coating material is highly conductive, the contents of the metallic container, as well as the metallic container itself, are electrostatically charged as an incident to electrostatically charging the coating material during spraying, whether the electrostatic charging electrode is incorporated in the nozzle assemly 13, the hose 24 (as shown), or connected directly to the metallic tank 28. Were the cover 46 to be removed without provision for automatically grounding the system, a serious safety hazard would be presented by virtue of the charged nature of the container 28 were personnel to inadvertently contact the exposed container after the cover 46 has been removed.

As described, in the preferred form of the invention the automatic electrostatic grounding arrangement includes a high voltage grounding switch 58 which is located in a compartment 54 of the insulative enclosure 45 which is separate and apart from the compartment 50 in which the paint tank 28 is housed. Placement of the high voltage switch assembly 58 in a separate compartment, vis-a-vis in the same compartment as the tank 28, provides a number of unobvious advantages. For example, with the high voltage switch 58 absent from the tank compartment 50, the switch is protected against possible damage due to paint spillage, jarring or the like, as an incident to tank replenishment and/or removal. In addition, the high voltage switch compartment 54, by reason of being separate from the tank compartment 50, can be sealed against unauthorized tampering or the like without inconveniencing personnel needing access to the tank compartment for replenishment purposes, etc. Finally, the size of the tank compartment 50 can be made smaller since the requisite electrical standoff between the tank 28 and tank compartment walls can be provided by measuring directly from the tank walls to the compartment walls, rather than from the compartment walls to the high voltage electrical switch which, if located in the tank compartment, would be mounted on the tank, thereby increasing the actual distance required between tank and compartment walls to provide a predetermined electrical standoff.

As also described in connection with the preferred embodiment of the invention, the hose 24 which supplies the highly conductive paint from the tank 28 to the gun 10 passes through the high voltage switch compartment 54. In the compartment 54 an electrode or plate 38, which communicates with the hose bore 24*c* carrying the highly conductive water-based paint, is alternately selectively connected to either the high voltage source 44 via line 42 for charging the paint or to ground via the high voltage switch arrangement 58 and line 61 for discharging the system. This structural aspect of the preferred embodiment of the invention also provides a number of unobvious advantages. For example, by virtue of this arrangement the paint hose 24 serves the multifold purpose of transporting paint from the tank 28 to the gun 10, as well as establishing a conductive path for both charging the paint and grounding the system. As a consequence, removal of the tank 28 for maintenance or the like is easier since once the tank compartment cover 46 is removed and the cover 30 of the tank unclamped and taken off, the only fitting to the tank 28 requiring disconnection is the fitting 28*a* interconnecting the tank 28 and paint hose 24. Thus, by reason of the multiple functions performed by hose 24, tank removal can be made without need for disconnecting separate electrical conductors between the tank and sources of charging potential and ground potential which might otherwise be required for charging the paint and discharging the system.

A further advantage of this particular aspect of the invention is that the number of openings between the tank and high voltage switch compartments 50 and 54 is minimized by reason of the fact that separate openings are not needed for connecting charging and discharging conductors to the tank. The only openings needed are those to accommodate the paint hose 24 and air hose 32. Accordingly, only two seals $S_1$ and $S_2$ need be provided in the wall between the compartments 50 and 54, reducing initial equipment manufacturing cost as well as operating problems occasioned by paint spillage from the tank compartment 50 into the high voltage switching compartment 54.

To further minimize safety hazards to operating personnel, a cover-operated electrical interlock switch assembly 64 and a trigger-operated electrical interlock switch assembly 67 are provided. The cover-operated electrical interlock switch assembly 64 includes a pair of electrical contacts 64*a* and 64*b* which are adapted to be electrically connected by a movable electrically conductive switch element 64*c* when the cover 46 is in the closed position with the rim 46*a* thereof seating on base lip 48*a*. An insulative switch actuator in the form of a vertically shiftable plunger 64*d* slidably interfits in a hole 68 formed in the base rim 48*a*. The plunger 64*d* at its lower end is secured to the conductive contact-bridging element 64*c* such that when the cover 46 seats on the base 48 the conductive element 64*c* bridges contacts 64*a* and 64*b*. When the cover 46 is removed from the base 48, the plunger 64*d* is free to rise under the action of a compression spring 69 located between a stationary portion 70 of the base 48 and the contact-bridging element 64*c*, disconnecting contacts 64*a* and 64*b*.

The switch contacts 64*a* and 64*b* are connected between a low voltage source 71, such as a conventional 60 Hertz, 120 volt supply, and the high voltage power supply 44. Whenever the cover 46 is removed from the base 48, open-circuiting switch contacts 64*a* and 64*b*, the electrical circuit between the low voltage source 71 and the high voltage supply 44 is interrupted, disabling the high voltage supply 44. Thus, whenever the cover 46 is removed to expose the metallic container 28, which as noted contains electrically conductive coating material, the supply of electrostatic charging potential to the coating material via line 42, plate 38 and fitting 36, and hence to the container 28, is terminated.

The trigger-operated electrical interlock switch assembly 67 includes stationary switch contacts 67*a* and 67*b* which are adapted to be electrically connected by a conductive bridging element 67*c* when the trigger 18 is placed in its actuated position shown in solid lines in FIG. 1. The bridging element 67*c* is mounted for movement with the trigger 18 via an insulative stud 73. A compression spring 72 normally places the trigger 18 in its de-actuated position shown in dotted lines in FIG. 1. In the de-actuated trigger position the valve 17 is closed, terminating the flow of electrically conductive coating material to the gun and the switch contacts 67*a* and 67*b* are open-circuited.

Switch contacts 67*a* and 67*b* are connected between the low voltage supply 71 and the high voltage supply 44. Thus, when the trigger 18 is placed in its de-actuated condition shown in dotted lines in FIG. 1, the circuit between the low voltage supply 71 and the high voltage supply is interrupted, disabling the high voltage supply. Hence, any time the trigger 18 is released to terminate spraying of conductive coating, the application of high voltage from the supply 44 to the conductive coating material via line 42, plate 38 and fitting 36, is terminated. This reduces safety hazards should the operator, after releasing the trigger, bring the nozzle of the gun into contact with a grounded object such as when placing the gun on a grounded support.

In a preferred embodiment of the invention the trigger-operated interlock switch contacts 67*a* and 67*b* and the cover-operated interlock switch contacts 64*a* and 64*b* are connected in electrical series circuit relation between the low voltage supply 71 and the high voltage supply 44. As such, the supply of electrostatic charging potential to the coating material terminates when either the cover 46 is removed to expose the metallic container 28 containing the coating material, or the trigger 18 is released upon conclusion of spraying.

While the cover-operated interlock switch assembly 64 has been described as being operated by a cover-actuated plunger 64*d*, other switching arrangements operated in response, or as an incident or requisite, to removal of the cover could be utilized. For example, the switch contacts 64*a* and 64*b* could be incorporated in a magnetic reed switch located proximate the lip 48*a* of the base 48 to be operated by a permanent magnet mounted to the rim 46*a* of the cover. In accordance with such an arrangement, when the cover is seated on the base the permanent magnet associated with the cover rim 46*a* actuates the reed switch to place the contacts 64*a* and 64*b* in electrical contact, which condition continues until the cover 46 is removed from the base and the permanent magnet associated with the rim 46*a* thereof displaced from the reed switch associated with base lip 48*a*. Similarly, other forms of cover-operated interlock switches could be utilized including those operating on optical principles, other forms of proximity switches, etc. The trigger-operated interlock switch assembly 67 may, like the cover-operated interlock switch 64, take forms other than that shown. In fact, the switch 67 could be located remote from the trigger 18, but operated in response to gun trigger movements in accordance with well known pneumatic switch-operating techniques. In addition, disablement of the high voltage power supply 44 by switches 64 and 67 could be accomplished by placement of the switches other than in series between the power supply 71 and the high voltage supply 44.

Figure 4:
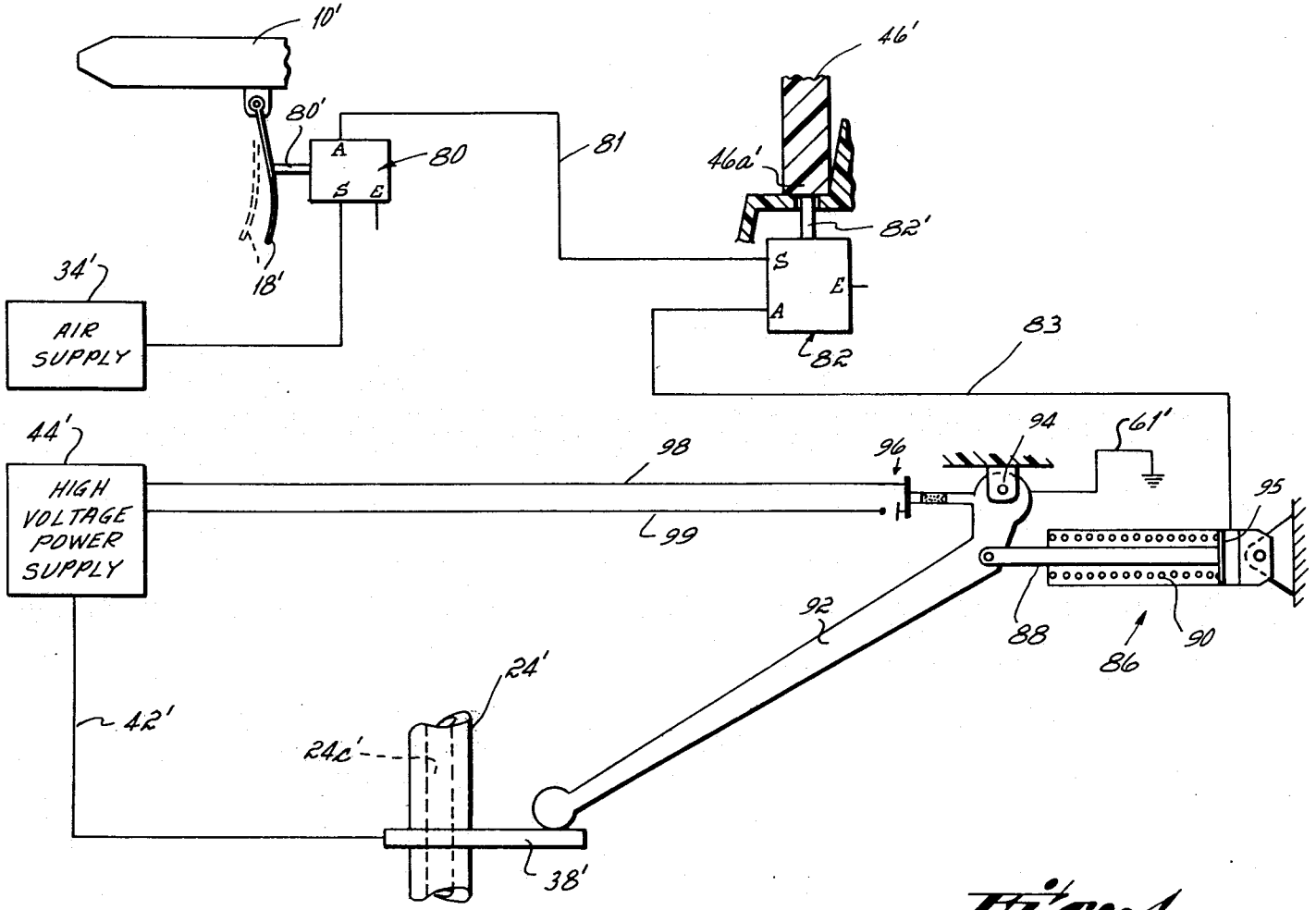
FIG. 4 is a schematic view of a portion of a second embodiment of the invention which is operative to ground the system when either the cover of the insulative tank enclosure is removed or the flow of coating material to the spray device terminates for longer than a predetermined interval.

In accordance with the embodiment depicted in FIG. 4, the system is automatically grounded when either or both of two events occur, namely, when either or both the cover 46' of the insulative tank enclosure is removed, or the trigger 18' of the spray gun 10' is released, terminating the flow of coating material, for a time period exceeding a predetermined interval. The apparatus includes a first air valve 80 responsive to the trigger 18' of the gun 10' and a second air valve 82 responsive to the position of the cover 46' of the insulative tank enclosure. The air valves 80 and 82 are connected in a logical OR configuration between an air supply 34' and an air operated piston/cylinder actuator 86 such that an actuating rod 88 is returned by a spring 90 to its inner position (shown in FIG. 4) whenever the tank enclosure cover 46' is removed and/or the gun trigger 18' is released. Return of the actuating rod 88 to its inner position (shown in FIG. 4) under either or both of the foregoing circumstances pivots an electrically conductive rod 92 about a stationary pivot point 94 to the position shown in FIG. 4 wherein it contacts electrode 38' communicating withthe bore 24*c* of the coating supply hose 24'. With rod 92 contacting electrode 38', the electrode 38' is connected to ground potential via rod 92 and line 61'. Since the grounded electrode 38' contacts the electrically conductive water-based paint flowing in hose bore 24*c*, the system is grounded, dissipating electrical energy stored therein in capacitive form. In addition to grounding the system when the conductive rod 92 is in the position shown in FIG. 4, the rod 92 also places a switch 96 in its normally open circuit position to electrically disconnect wires 98 and 99. With wires 98 and 99 disconnected, the high voltage power supply 44' is de-energized, terminating the supply of high voltage charging potential to the electrode 38' via line 42', in turn removing charging potential from the coating material.

The valve 80, considered in greater detail, has an inlet port S connected to the air supply 34', an outlet port A, and an exhaust port E. Valve 80 also includes a movable actuator 80' responsive to the gun trigger 18'. When the gun trigger 18' is in its actuated position (shown in solid lines in FIG. 4) to permit the flow of coating material to the gun 10' via hose 24', inlet port S of valve 80 is connected to outlet port A of valve 80, providing pressurized air on line 81. The valve 80 is constructed such that when the gun trigger 18' is released for a predetermined interval or longer to terminate the flow of coating material to the gun 10', that is, is moved to the dotted line position shown in FIG. 4 and maintained in such position for a predetermined interval or longer, port S and port A are disconnected and port A vents to atmosphere via exhaust port E. If the trigger 18' is released for a duration less than or equal to the predetermined interval, and thereafter reactuated and returned to its solid line position, ports S and A do not become disconnected.

The predetermined interval of trigger release required before ports S and A valve 80 become disconnected is preferably adjustable, for example, selectable in the approximate range of 1–6 seconds. Trigger releases equal or less than such predetermined interval are associated with normal momentary trigger releases encountered during spraying when de-energization of the charging source and grounding of the system are not desired due to the time lag occurring after trigger actuation before the system charges to its operating level, while trigger releases greater than the predetermined interval are associated with the conclusion of spraying, such as when the tank is to be replenished, and system discharge and charging source de-energization are desired.

When the gun trigger 18' is moved to its release position and remains released for a continuous duration exceeding the predetermined interval for which the valve 80 is set, the ports S and A are disconnected, with port A venting to atmosphere via exhaust port E, and remain so until the trigger is reactuated. In this condition pressure is removed from line 81. Upon reactuation of the trigger 18', the ports S and A are immediately connected to place pressurized air on line 81. Valve 80 may be of any conventional type, such as a three-way normally closed time delay valve commercially available from Clippard, Inc., designated Model No. R-331.

Valve 82 has input port S, an output port A and exhaust port E. The valve 82 has an actuator 82' which is responsive to the position of the cover 46' of the tank enclosure. When the cover 46' is in its closed position preventing access to the tank, the cover lip 46*a'* places actuator 82' in the actuated position shown in FIG. 4, connecting port S to port A. Assuming the gun trigger 18' is actuated placing pressure on line 81, when the cover 46' of the tank enclosure is in its closed position shown in FIG. 4, actuating actuator 82' which in turn causes ports S and A to be connected, pressure will be present on line 83. With line 83 pressurized, the piston 95 is driven leftwardly in stationarily mounted cylinder 86 to drive the actuator 88 toward the left, in turn pivoting rod 92 clockwise about point 94. Pivotal movement of rod 92 in the manner indicated removes ground potential from the electrode 38', as well as actuates switch 96 to cause high voltage from the supply 44' to be input via line 42' to the electrode 38' to charge the coating material flowing in the hose 24'. Should the cover 46' of the tank enclosure be removed, the valve actuator 82' immediately moves upwardly, disconnecting ports S and A of valve 82 and instead connecting port A to exhaust port E. With ports A and E of valve 82 connected, even if pressure exists in line 81 due to actuation of the gun trigger 18', there is no pressure in line 83 and the piston 95 and actuator 88 return to their rightmost position under the action of spring 90. Movement of the actuator 88 to the right grounds electrode 38' to discharge the system, as well as places switch 96 in an open-circuit condition to de-energize the power supply 44' and remove high voltage charging potential from electrode 38'. Valve 82 may be of any conventional type, such as a three-way poppit valve commercially available from Clippard, Inc., designated Model No. MAV-3P.

In the embodiment of FIG. 4, valve 80 is responsive to the gun trigger 18' which regulates flow of coating material to the gun 10' of an "airless" spray system, i.e., a system in which the coating is atomized hydraulically. If an "air" system is used in which the coating is atomized in the nozzle by impingement with atomizing air supplied to the gun, the valve 80 could be responsive to the flow of the atomizing air. That is, the valve 80 could be actuated to immediately connect its ports S and A when a flow of atomizing air is present, and could be deactuated to connected port A to port E when the atomizing air flow has been terminated for a duration exceeding the predetermined interval. Alternatively, valves 80 and 82 could be replaced by electrical switches responding to the trigger 18' and enclosure cover 46' similar to switches 64 and 67 of FIG. 1.

Having described the invention, it is claimed:

1. A system for electrostatically spraying highly electrically conductive water-based coating material with improved safety, comprising:

a spray device for directing electrostatically charged water-based coating material toward an object to be coated which is maintained at a potential different from that of the charged coating material, a container for highly electrically conductive water-based coating material, a fluid conduit interconnecting said container and said spray device for transporting water-based coating material from said container to said spray device, said fluid conduit having a bore through which coating material is transported from said container to said spray device, said conduit including:

a. an inner zone surrounding said bore, said inner zone including material which is substantially chemically inert and impermeable to said water-based coating material, b. an outer zone of dielectric material surrounding said inner zone, said outer zone having an exterior surface which is substantially free of electrically conductive material to minimize the capacitance of the conduit, and hence the electrical energy stored in the conduit in capacitive form, when the conduit is physically spaced from a grounded object, said inner and outer zones having dielectric constants and radial thicknesses to avoid dielectric breakdown therein when subjected to a potential difference equal to the difference in potential between ground potential and the potential existing at the interface of the transported coating and the inner zone, and a source of electrostatic charging potential for charging water-based coating material in said container, conduit and spray device, said fluid conduit having a length and cross-section dimensioned to provide a very low electrical resistance between said spray device and container whereby said water-based coating material in said container, conduit and spray device is charged to an electrostatic potential substantially the same as output from said electrostatic charging source.

2. A system for electrostatically spraying highly electrically conductive water-based coating material with improved safety, comprising:

a spray device for directing electrostatically charged water-based coating material toward an object to be coated which is maintained at a potential different from that of the charged coating material, a container for highly electrically conductive water-based coating material, a fluid conduit interconnecting said container and said spray device for transporting water-based coating material from said container to said spray device, said fluid conduit being hollow and having a dielectric wall with a zone in contact with the coating which is substantially chemically inert and impermeable to the water-based coating, said wall constructed to withstand dielectric breakdown when subjected to an electrical potential by electrostatically charged coating material in said conduit, said conduit having an exterior surface which is substantially free of electrically conductive material to minimize the capacitance of the conduit, and hence the electrical energy stored in the conduit in capacitive form, when the conduit is physically spaced from a grounded object, and a source of electrostatic charging potential for charging water-based coating material in said container, conduit and spray device, said fluid conduit having a length and cross-section dimensioned to provide a very low electrical resistance between said spray device and container whereby said water-based coating material in said container, conduit and spray device is charged to an electrostatic potential substantially the same as output from said electrostatic charging source.

3. A fluid conduit for minimizing safety hazards when transporting electrostatically-charged water-based coatings between a coating container and a spray device, said coating being charged from an electrostatic source, said fluid conduit comprising:

a hollow hose having a dielectric wall with a zone in contact with the coating which is substantially chemically inert and impermeably to the water-based coating, said wall constructed to withstand dielectric breakdown when subjected to an electrical potential by electrostatically charged coating material in said hose, said hose having an exterior surface which is substantially free of electrically conductive material to minimize the capacitance of the hose, and hence the electrical energy stored in the hose in capacitive form, when the hose is physically spaced from a grounded object, said fluid hose having a length and cross-section dimensioned to provide a very low electrical resistance between said spray device and container whereby said water-based coating material in said container, hose and spray device is charged to an electrostatic potential substantially the same as output from said electrostatic charging source.

4. A fluid conduit for minimizing safety hazards when transporting electrostatically-charged water-based coatings between a coating container and a spray device, said coating being charged from an electrostatic source, said fluid conduit comprising:

a hose having a bore through which coating material is transported from said container to said spray device, said hose including:

a. an inner zone surrounding said bore, said inner zone including material which is substantially chemically inert and impermeable to said water-based coating material, b. an outer zone of dielectric material surrounding said inner zone, said outer zone having an exterior surface which is substantially free of electrically conductive material to minimize the capacitance of the hose, and hence the electrical energy stored in the hose in capacitive form, when the hose is physically spaced from a grounded object, said inner and outer zones having dielectric constants and radial thicknesses to avoid dielectric breakdown therein when subjected to a potential difference equal to the difference in potential between ground potential and the potential and the potential existing at the interface of the transported coating and the inner zone, said fluid hose having a length and cross-section dimensioned to provide a very low electrical resistance between said spray device and container whereby said water-based coating material in said container, hose and spray device is charged to an electrostatic potential substantially the same as output from said electrostatic charging source.

5. The system of claim 2 wherein said zone is tetrafluroethylene.

6. A system for electrostatically spraying highly electrically conductive water-based coating material with improved safety, comprising:

a spray device for directing electrostatically charged water-based coating material toward an object to be coated which is maintained at a potential different from that of the charged coating material, a container for highly electrically conductive water-based coating material, a fluid conduit interconnecting said container and said spray device for transporting water-based coating material from said container to said spray device, said fluid conduit having a bore through which coating material is transported from said container to said spray device, said conduit including:

a. an inner zone surrounding said bore, said inner zone including material which is substantially chemically inert and impermeable to said water-based coating material, b. an outer zone of dielectric material surrounding said inner zone, said outer zone having an exterior surface which is substantially free of electrically conductive material to minimize the capacitance of the conduit, and hence the electrical energy stored in the conduit in capacitive form, when the conduit is physically spaced from a grounded object, said inner and outer zones having dielectric constants and radial thicknesses to avoid dielectric breakdown therein when subjected to a potential difference equal to the difference in potential between ground potential and the potential existing at the interface of the tranported coating and the inner zone, and a source of electrostatic charging potential for charging water-based coating material in said container, conduit and spray device, said inner zone being tetrafluroethylene and said outer zone being fabricated of material which exhibits substantially a greater flexibility than said inner zone.

7. The system of claim 6 further including a skin of material surrounding said outer zone which exhibits substantially greater abrasion resistance than said outer zone, said skin having an exterior surface substantially free of electrically conductive material to minimize the capacitance of the hose, and hence the electrical energy stored in the hose in capacitive form, when the hose is physically spaced from a grounded object.

8. The hose of claim 3 wherein said zone is tetrafluroethylene.

9. The hose of claim 4 further including a skin of material surrounding said outer zone which exhibits substantially greater abrasion resistance than said outer zone, said skin having an exterior surface substantially free of electrically conductive material to minimize the capacitance of said hose, and hence the electrical energy stored in said hose in capacitive form, when the hose is physically spaced from a grounded object.

* * * * *

UNITED STATES PATENT AND TRADEMARK OFFICE

CERTIFICATE OF CORRECTION

PATENT NO. : 3,971,337

DATED : July 27, 1976

INVENTOR(S) : Donald R. Hastings

It is certified that error appears in the above-identified patent and that said Letters Patent are hereby corrected as shown below:

Column 4, line 4: insert the word "by" between the words "system" and "means".

Column 16, line 23, Claim 3: "impermeably" should be --impermeable--.

Signed and Sealed this

Ninth Day of November 1976

[SEAL]

*Attest:*

RUTH C. MASON
*Attesting Officer*

C. MARSHALL DANN
*Commissioner of Patents and Trademarks*